US007399397B2

(12) United States Patent
Buettner et al.

(10) Patent No.: US 7,399,397 B2
(45) Date of Patent: Jul. 15, 2008

(54) PROCESS FOR THE PRODUCTION OF COATED SUBSTRATES

(75) Inventors: Gabriele Buettner, Ratingen (DE); Heinz-Peter Katzmann, Wuppertal (DE); Klausjoerg Klein, Wuppertal (DE)

(73) Assignee: E.I. du Pont de Nemours and Company, Wilmington, DE (US)

( * ) Notice: Subject to any disclaimer, the term of this patent is extended or adjusted under 35 U.S.C. 154(b) by 982 days.

(21) Appl. No.: 10/842,312

(22) Filed: May 10, 2004

(65) Prior Publication Data

US 2005/0249883 A1 Nov. 10, 2005

(51) Int. Cl.
*C25D 13/12* (2006.01)

(52) U.S. Cl. ..... 204/488; 427/409

(58) Field of Classification Search ..... 204/488; 427/409; 205/317

See application file for complete search history.

(56) References Cited

U.S. PATENT DOCUMENTS

| | | | | |
|---|---|---|---|---|
| 4,959,277 | A | 9/1990 | Saeki et al. | |
| 5,348,634 | A | 9/1994 | Matsuo et al. | |
| 5,438,083 | A | 8/1995 | Takimoto et al. | |
| 5,709,909 | A | 1/1998 | Leibfarth et al. | |
| 5,968,655 | A | 10/1999 | Hartung et al. | |
| 5,976,343 | A | 11/1999 | Schlaak | |
| 6,350,359 | B1 * | 2/2002 | Doebler et al. | 204/488 |
| 6,811,665 | B2 * | 11/2004 | Blum et al. | 204/486 |

FOREIGN PATENT DOCUMENTS

| | | | |
|---|---|---|---|
| EP | 0 157 392 | A2 | 10/1985 |
| EP | 0 448 341 | A1 | 9/1991 |
| EP | 0 508 428 | A1 | 10/1992 |
| EP | 0 558 837 | A1 | 9/1993 |
| EP | 0 573 015 | A1 | 12/1993 |
| EP | 0 573 016 | A1 | 12/1993 |
| EP | 0 611 095 | A1 | 8/1994 |
| EP | 0 611 810 | A2 | 8/1994 |
| WO | WO 97/47401 | A1 | 12/1997 |
| WO | WO 98/23390 | A1 | 6/1998 |

* cited by examiner

*Primary Examiner*—Kishor Mayekar
(74) *Attorney, Agent, or Firm*—Joachim Blum

(57) ABSTRACT

A process for the production of coated substrates comprising the successive steps of:

a) applying a coating composition A' onto one side A" of a metal sheet to form a coating layer A which is electrically insulating when cured and applying a coating composition B' onto the opposite side of the metal sheet to form coating layer B which is electrically conductive when cured, wherein each of the coating compositions A' and B' are applied by coil coating, b) curing the two coating layers A and B, c) removing and shaping sheet metal parts provided with the cured coating layer A on one side A" and with the cured coating layer B on the other side B", d) optionally, assembling the coated shaped sheet metal parts to form a construction with outwardly directed sides A" and e) electrodepositing an electrodeposition (ED) coating layer onto the electrically conductive surfaces and curing of the ED coating layer.

12 Claims, No Drawings

PROCESS FOR THE PRODUCTION OF COATED SUBSTRATES

BACKGROUND OF THE INVENTION

1. Field of the Invention

The invention relates to a process for the production of coated substrates and to the coated substrates.

2. Description of the Prior Art

WO 98/23390 discloses a coating process in which a primer, which is electrically conductive when baked, is coil coated onto both sides of a metal sheet and is baked and sheet metal parts are then stamped out of the sheets coated in this way and are shaped by deep-drawing. These coated sheet metal parts may then be assembled to form a construction, for example, a motor vehicle body. After shaping and optionally assembly, a base coat/clear coat two-layer coating is applied, either the base coat or, if an intermediate coat is applied before application of the base coat, the intermediate coat is applied by electrodeposition, (ED coating). An essential feature is that the primer applied by the coil coating process is applied sufficiently thinly to have sufficient electrical conductivity for subsequent ED coating and/or the coil coating composition contains components which impart electrical conductivity.

In the past, a coating process, which became known as the "reverse process", was used, wherein initially a primer surfacer layer was spray-applied directly to the metal outer skin of a car body and baked. Then, an ED coating primer was applied to the metal surfaces inside the car body, which had remained uncoated, and baked (see G. Fettis, Automotive paints and coatings, Verlag Chemie, Weinheim, 1995, pages 61-63).

SUMMARY OF THE INVENTION

The present invention combines the advantages of the reverse process with those of a coil coating process.

The invention relates to a process for the production of coated substrates comprising the successive steps of:

a) applying a coating composition A' onto one side A" of a metal sheet to form coating layer A which is electrically insulating when cured, and applying coating composition B' onto the opposite side B" of the metal sheet to form coating layer B which is electrically conductive when cured, wherein each of the coating compositions A' and B' are applied by coil coating, b) curing the two coating layers A and B, c) removing and shaping sheet metal parts provided with the cured coating layer A on one side A" and with the cured coating layer B on the other side B", d) optionally, assembling the coated shaped sheet metal parts to form a construction with outwardly directed side A" and e) electrodepositing an ED coating layer onto the electrically conductive surfaces and curing of the ED coating layer.

DETAILED DESCRIPTION OF THE EMBODIMENTS

In process step a) of the process according to the invention, a coating layer A which is electrically insulating when cured from a coating composition A' is applied onto one side A" and a coating layer B which is electrically conductive when cured from a coating composition B' is applied onto the other side B" of a metal sheet; each coating layer is applied by conventional and known coil coating application.

The terms "electrically conductive" and "electrically insulating" are used in the description and in the claims. "Electrically conductive" means paintable by ED coating whereas "electrically insulating" means that the electrical conductivity required and adequate for the electrodeposition of an ED coating layer is not provided.

The term "film thickness" used in the description and in the claims means dry film thickness.

Metal sheets which are rolled into coils, for example, with a sheet thickness of 0.7 to 1.3 mm, for example, comprising iron, zinc, aluminum or corresponding alloys, are used as metal sheets. Galvanized sheet metal, for example, galvanized sheet steel, is preferred. The metal surfaces may be pretreated, for example, phosphated and optionally passivated. The metal surfaces may have roughnesses with average roughness values ($R_a$-values, cf. DIN/EN 10130), for example, of 0.6 to 1.8 μm. Since it is not necessary to use deep-drawing aids during shaping in process step c), it is possible and also preferable to use metal sheets with lower surface roughnesses having $R_a$-values lower than 0.6 μm, for example, from 0.1 to 0.6 μm. Artificial roughening of the sheet metal surface is therefore unnecessary.

The coating layer A is applied from the coating composition A' onto one side A" of the metal sheet so as to produce a coating layer which is electrically insulating when baked, i.e. the baked coating layer A has such low electrical conductivity that an ED coating layer cannot be deposited thereon. This can be achieved in that the coating composition A', in particular, contains no components which are capable of imparting electrical conductivity and/or in that the coating layer A is applied in a sufficiently high, i.e. electrically insulating film thickness. For example, the volume resistivity of a coating layer A applied from a coating composition A' and cured is higher than $10^8$ Ohm·cm, for example, up to $10^{11}$ Ohm·cm, and it is applied in a film thickness of, for example, 5 to 50 μm, preferably 15 to 25 μm. The volume resistivity may be measured by conventional methods known to the skilled person, as described, for example, in DIN IEC 93.

The opposite applies to the coating layer B. The coating layer B is applied from the coating composition B' to the other side B" of the metal sheet so as to produce a coating layer which is electrically conductive when baked and on which an ED coating layer may be electrodeposited. This may be achieved in that the coating composition B' contains components which are capable of imparting electrical conductivity and/or in that the coating layer B is applied in a sufficiently thin film thickness, which allows electrical conductivity sufficient for the electrodeposition of ED paint. For example, the volume resistivity of a coating layer B applied from a coating composition B' and cured is $10^3$ to $10^8$ Ohm·cm and it is applied in a film thickness of, for example, 2 to 25 μm, preferably 5 to 15 μm or, in the case of a higher volume resistivity, for example, $10^8$ or $10^{11}$ Ohm·cm or more, it is applied in a film thickness of, for example, only 1 to 5 μm.

The two coating compositions A' and B', which may also be the same or different, are liquid coating compositions which may be applied by coil coating. They may be aqueous or solventborne coating compositions. They may be physically drying. They can generally be crosslinked to form covalent bonds. In the latter case, they may be systems which are self-crosslinkable or require the addition of a crosslinking agent.

The coating compositions A' and B' contain one or more film-forming binders. They can optionally also contain crosslinking agents, in particular if the binders are not selfcrosslinking or physically drying (thermoplastic). The binder component and the crosslinking agent component are not subject to any restrictions as such; resins which are conventional in paints and familiar to a person skilled in the art may be used. The person skilled in the art will preferably select binder systems which are resistant to chalking and weathering. For example, polyester, polyurethane and/or (meth) acrylic copolymer resins may be used as film-forming binders, epoxy resins also being possible but less preferred.

The choice of the optionally contained crosslinking agents is based on the functionality of the binders, i.e. the crosslinking agents are selected from conventional crosslinking agents familiar to a person skilled in the art such that they have reactive functionality which is complementary to the functionality of the binders. Examples of these complementary functionalities between binders and crosslinking agents are: hydroxyl/methylolether, hydroxyl/blocked isocyanate. If they are compatible with one another, a plurality of these complementary functionalities may coexist. The optionally used crosslinking agents may exist individually or in combination.

As described hereinbefore, the coating composition B' can contain, in particular, components which impart electrical conductivity. Electrical conductivity imparting components may impart volume resistivity which is sufficiently low for the electrodeposition of a coating layer from an ED coating composition, for example, of $10^3$ to $10^8$ Ohm·cm, to the baked coating layer B.

Examples of such components are particulate inorganic or organic electrical conductors or semi-conductors, such as, for example, black iron oxide, graphite, conductive carbon black, metal powder, e.g. of aluminum, zinc, copper or refined steel, molybdenum disulfide, conductive pigments, such as, for example, doped pearlescent pigments, for example, mica platelets provided with a thin layer of antimony-doped tin oxide, or conductive barium sulfate in which the particle core is coated with a thin layer of antimony-doped tin oxide. Electrically conductive polymers, such as, e.g., polyaniline, are also suitable but less preferred. The electrical conductivity imparting components are contained in the coating composition B' in such a quantity that the sufficiently low volume resistivity of the coating layer B is achieved when baked. Based on the solids content of the coating composition B', the proportion of electrical conductivity imparting component(s) is, for example, from 1 to 30% by weight. The proportion may easily be determined by a person skilled in the art; for example, it is dependent on the specific gravity, the specific electrical conductivity and the particle size of the electrical conductivity imparting components used. One or more of these components may be combined in the coating composition B'. Coating composition A' preferably contains no electrical conductivity imparting components or such small quantities thereof that an electrically insulating coating layer A is obtained.

The coating compositions A' and B' preferably contain pigments and/or fillers (extenders). Pigments and fillers include, for example, conventional inorganic or organic pigments and/or fillers. Examples include carbon black, titanium dioxide, iron oxide pigments, kaolin, talc, silicon dioxide and, in particular, corrosion-preventing pigments, such as, zinc chromate, strontium chromate, lead silicate, zinc phosphate, aluminum phosphate.

The coating compositions A' and B' may also contain conventional additives. Examples include conventional paint additives, such as, wetting agents, dispersing agents, emulsifiers, leveling agents, corrosion inhibitors, antifoaming agents and lubricants.

Coating compositions A' and B' which are suitable for the application of coating layers A and B in process step a) and which do not contain specific, or contain only small amounts of, electrical conductivity imparting components are described, for example, in U.S. Pat. No. 4,959,277, U.S. Pat. No. 5,438,083, EP-A-0 448 341, EP-A-0 508 428, EP-A-0 558 837, EP-A-0 573 015, EP-A-0 573 016, EP-A-0 611 095, EP-A-0 611 810. These are coating compositions from which, while maintaining a small film thickness of, for example, 1 to 3 μm, coating layers may be produced which are electrically conductive when baked, but are electrically insulating in greater film thicknesses, for example, higher than 3 to 30 μm when baked, i.e. do not allow to be overcoated by ED coating.

Examples of coating compositions which may be applied by coil coating as coating composition B' in step a) of the process according to the invention and which may be applied in a higher film thickness of, for example, 2 to 15 μm, preferably 3 to 10 μm, owing to their content of electrical conductivity imparting components, are described in EP-A-0 157 392 and U.S. Pat. No. 5,348,634. These are coating compositions from which there may be produced coating layers which when baked have a sufficient electrical conductivity for the electrodeposition of a subsequent coating layer from an ED coating composition.

Once the coating compositions A' and B' have been applied by coil coating in process step a) the coating layers A and B thus produced are cured in the following process step b), in particular by baking. Baking is carried out for a short time at elevated temperatures, for example, within 30 to 60 seconds, for example, in a convection oven at 300 to 370° C., object temperatures (PMT, peak metal temperature) of, for example, between 200 and 260° C. being achieved.

The coating layers A and/or B may, of course, also, each be applied in a plurality of coil coating applications from respectively identical or different coating compositions A' and B' and cured, providing that the finally resulting cured coating layer A is electrically insulating in the above-described sense and the finally resulting cured coating layer B is electrically conductive in the above-described sense.

After curing according to process step b), sheet metal parts of the required shape are removed (separated), for example, stamped or cut out, in the conventional manner in process step c) from the metal coil which is coated on both sides and are then also shaped in the conventional manner by deep-drawing. It is not necessary to use deep-drawing aids. Shaped sheet metal parts coated on both sides with a coated electrically insulating side A" and a coated electrically conductive side B" are obtained in process step c). It is important that side A" is the exterior, i.e. the shaping process is carried out accordingly.

The coated shaped sheet metal parts produced in process step c) may then be assembled, optionally together with other components, with their sides A" turned outwards, to form a construction, in particular a motor vehicle body, in optional process step d), for example, by adhesive bonding and/or clinching and/or screwing and/or welding. The other components may be, for example, uncoated or precoated metal parts or plastics parts. All or some of the parts used during production of the construction may be joined together in such a way that they are in electrical contact with one another, i.e. are joined together in an electrically conductive manner.

As already mentioned, the coated side A" of the shaped sheet metal parts is the exterior, i.e. the side A" is the surface facing an external observer, or in brief the outer visible face. The outer visible faces are outer surfaces. In the case of motor vehicle bodies, this is, for example, the body surface which is immediately visible to the observer (outer body skin).

In the case of motor vehicle bodies, for example, a supporting metal internal frame may be provided externally with the coated shaped sheet metal parts, the sides A" thereof being directed outwardly, i.e. toward an external observer.

The coated shaped sheet metal parts or the constructions comprising the coated shaped sheet metal parts are ED coated in the conventional manner known to a person skilled in the art in process step e). As the external side A" coated with the cured coating layer A does not have sufficient electrical conductivity, an ED coating layer is not deposited thereon but only on the electrically conductive surfaces, i.e. on the sufficiently electrically conductive internal side(s) B" provided with the cured coating layer B and on the cut metal edges and, in the case of corresponding constructions, on any other electrically conductive components. The ED coating layer effectively protects the internal sides B", which are particularly subject to corrosion, and the metal edges of the coated shaped sheet metal parts produced in process step d) from corrosion.

The ED coating layer is electrodeposited from a conventional ED coating composition. Suitable ED coating compositions include conventional waterborne coating compositions with a solids content from, for example, 10 to 30 wt. %. The solids comprise conventional ED coating binders having ionic groups and, optionally, cross-linkers and further non-volatile components such as fillers (extenders), pigments and non-volatile additives as are conventional for paints.

The ED coating compositions may be conventional anodic ED (AED) coating agents known to the skilled person. The binder basis of the AED coating composition may be chosen at will. Examples of AED binders are polyesters, epoxy resin esters, (meth)acrylic copolymer resins, maleinate oils or polybutadiene oils with a weight average molecular mass (Mw) of, for example, 300 to 10000 and a carboxyl group content, for example, corresponding to an acid value of 35 to 300 mg KOH/g. At least a part of the carboxyl groups is converted to carboxylate groups by neutralization with bases. These binders may be self-cross-linking or cross-linked with separate cross-linking agents, such as aminoplastic resins, cross-linking agents containing groups capable of transesterification or blocked polyisocyanates.

Preferably, conventional cathodic ED (CED) coating agents known to the skilled person are used in the process according to the invention for the application of the ED coating layer. CED coating compositions contain binders with cationic groups or groups which can be converted to cationic groups, for example, basic groups. Examples include amino, ammonium, e.g., quaternary ammonium, phosphonium and/or sulfonium groups. Nitrogen-containing basic groups are preferred; said groups may be present in the quaternized form or they are converted to cationic groups with a conventional neutralizing agent, e.g., an organic monocarboxylic acid such as, e.g., formic acid, lactic acid, methane sulfonic acid or acetic acid. Examples of basic resins are those with primary, secondary and/or tertiary amino groups corresponding to an amine value from, for example, 20 to 200 mg KOH/g. The weight average molecular mass (Mw) of the binders is preferably 300 to 10000. Examples of such binders are amino (meth)acrylic resins, aminoepoxy resins, aminoepoxy resins with terminal double bonds, aminoepoxy resins with primary OH groups, aminopolyurethane resins, amino group-containing polybutadiene resins or modified epoxy resin-carbon dioxide-amine reaction products. These binders may be self-cross-linking or they may be used in combination with known cross-linking agents. Examples of such cross-linking agents include aminoplastic resins, blocked polyisocyanates, cross-linking agents with terminal double bonds, polyepoxy compounds or cross-linking agents containing groups capable of transesterification.

Apart from binders and any separate cross-linking agents, the ED coating compositions may contain pigments, fillers and/or conventional coating additives.

Examples of suitable pigments include conventional inorganic and/or organic colored pigments and/or fillers, such as carbon black, titanium dioxide, iron oxide pigments, phthalocyanine pigments, quinacridone pigments, kaolin, talc or silicon dioxide.

Examples of additives include, in particular, wetting agents, neutralizing agents, levelling agents, catalysts, corrosion inhibitors, anti-cratering agents, anti-foaming agents, solvents.

ED coating compositions which have a good throwing power and/or are distinguished by good edge corrosion protection are preferably used in the process according to the invention.

The ED coating layer is electrodeposited in the conventional manner known to a person skilled in the art in a film thickness, for example, within a range of 3 to 40 μm, preferably 5 to 25 μm, for example, at deposition voltages of 200 to 500 V, preferably under application conditions which produce an optimum throw. These application conditions are known to a person skilled in the art. After the ED coating layer has been deposited, it is cured, in particular by baking, for example, at metal temperatures of 120 to 180° C.

In the case of coated shaped sheet metal parts (without process step d)), those may be assembled with their sides A" directed outwardly, optionally together with other components, to form a construction on completion of process step e), for example, in a further process step f1). For example, the construction may be a motor vehicle body. In the latter case, a supporting internal metal frame, which is, for example, protected from corrosion by a paint coating may be provided externally with the coated shaped sheet metal parts, the sides A" thereof being directed outwardly, i.e. facing an external observer.

On completion of process step e) or f1), there may be applied further materials and/or at least one further coating layer in a further process step f2); the latter may be applied from conventional liquid or powder coating compositions. In particular, in the case of motor vehicle bodies, for example, in the automotive industry, conventional subsequent materials may be applied such as underbody sealant, adhesives, sealing elements and/or one or more further conventional paint films may be applied, the latter in particular to the side(s) A". Examples include a clear coat, a pigmented one-layer top coat, an intermediate coat-free (primer surfacer-free) combination of color and/or effect-imparting base coat and subsequent clear coat or a multi-layer combination of intermediate coat (primer surfacer) and single-layer top coat or two-layer top coat of color and/or effect-imparting base coat and subsequent clear coat. In the case of the intermediate coat-free (primer surfacer-free) combinations, the color and/or effect-imparting base coat can comprise a system of modified base coat and unmodified base coat applied thereto.

Whereas, the unmodified base coats are conventional base coat coating compositions known to the person skilled in the art, the modified base coat systems are produced from the latter by mixing with an admixture component. Preferably, the admixture component causes the base coats modified with it to acquire typical intermediate coat or primer surfacer coat properties (stone-chipping resistance, equalization of the substrate surface). Admixture components suitable for such a modification of base coats are known from WO 97/47401, U.S. Pat. No. 5,976,343, U.S. Pat. No. 5,709,909 and U.S. Pat. No. 5,968,655. Said patent documents describe processes for producing decorative multi-layer coatings in which a multi-layer coating structure consisting of a modified base coat, a subsequently applied unmodified base coat and a finally applied clear coat is produced on a baked electrodeposition primer coating by the wet-in-wet-in-wet method. The modified base coat applied first of all is in said process produced from the subsequently applied base coat by the addition of an admixture component and replaces the function of a conventional intermediate coat or primer surfacer coat. Whereas, WO 97/47401 recommends the addition of polyisocyanate cross-linking agent, in U.S. Pat. No. 5,976,343, the addition of polyurethane resin or in U.S. Pat. No. 5,709,909 and in U.S. Pat. No. 5,968,655, the addition of a filler paste (extender paste) as admixture component is described.

In the case of shaped sheet metal parts (without process step d)), process step f2) may be followed by a further process step g), during which the coated shaped sheet metal parts are assembled with their sides A" directed outwardly, optionally together with other components, to form a construction. For example, the construction may be a motor vehicle body. In the latter case, a supporting internal metal frame, which is, for example, protected from corrosion by a paint coating, may be provided externally with the coated shaped sheet metal parts, the sides A" thereof being directed outwardly, i.e. facing an external observer.

With the process according to the invention, the advantages of the reverse process are ultimately combined with those of a coil coating process. Therefore, as also known from WO 98/23390, the use of deep-drawing aids such as drawing grease or oils may be dispensed with during shaping by deep-drawing. As a result, there is no need to clean the substrates from deep-drawing aids. Good corrosion protection of the points which are particularly at risk of corrosion is achieved by the ED coating of the internal sides B" and of the cut metal edges. As conventional ED layers are generally rougher than coating layers applied from other coating compositions, it is advantageous with regard to the surface appearance of the external visible faces A" that the external sides A" are not ED coated. A paint coating of excellent optical surface quality (appearance, gloss) is achieved on the external sides A", particularly if metal sheet with low surface roughness is used in process step a).

What is claimed is:

1. A process for the production of coated substrates comprising the successive steps of:

a) applying a coating composition A' onto one side A" of a metal sheet to form a coating layer A which is electrically insulating when cured and applying a coating composition B' onto the opposite side B" of the metal sheet to form a coating layer B which is electrically conductive when cured, wherein coating compositions A' and B' are each applied by coil coating, b) curing the two coating layers A and B, c) removing and shaping sheet metal parts provided with the cured coating layer A on one side A" and with the cured coating layer B on the other side B", d) optionally, assembling the coated shaped sheet metal parts to form a construction with outwardly directed side A" and e) electrodepositing an electrodeposition (ED) coating layer onto the electrically conductive surfaces and curing of the ED coating layer.

2. The process of claim 1, wherein the metal sheet used in process step a) has an average roughness value $R_a$ of 0.1 to 0.6 μm.

3. The process of claim 1, wherein the cured coating layer A has a volume resistivity higher than $10^8$ to $10^{11}$ Ohm·cm and a film thickness of 5 to 50 μm.

4. The process of claim 1, wherein the cured coating layer B has a volume resistivity of $10^3$ to $10^8$ Ohm·cm and a film thickness of 2 to 25 μm or a volume resistivity higher than $10^8$ to $10^{11}$ Ohm·cm and a film thickness of 1 to 5 μm.

5. The process of claim 1, wherein process step d) is omitted and, on completion of process step e), the coated shaped sheet metal parts are assembled with their sides A" directed outwardly to form a construction in a further process step f1).

6. The process of claim 5, wherein at least one further coating layer is applied in a further process step f2).

7. The process of claim 6, wherein the at least one further coating layer is applied on side(s) A".

8. The process of claim 1, wherein at least one further coating layer is applied in a further process step f2).

9. The process of claim 8, wherein the at least one further coating layer is applied on side(s) A".

10. The process of claim 1, wherein process step d) is omitted and, on completion of process step e), at least one further coating layer is applied in a further process step f2) and thereafter the so produced coated shaped sheet metal parts are assembled with their sides A" directed outwardly to form a construction in a further process step g).

11. The process of claim 1, wherein the construction also comprises other components in addition to the shaped sheet metal parts.

12. The process of claim 1, wherein the construction is a motor vehicle body.

* * * * *